US006106250A

United States Patent [19]

Morita et al.

[11] Patent Number: 6,106,250

[45] Date of Patent: Aug. 22, 2000

[54] LOBED-ROTOR-TYPE PUMP HAVING A COMMUNICATION PASSAGE BETWEEN WORKING-FLUID CHAMBERS

[75] Inventors: Shoji Morita, Aikawa; Yasushi Watanabe, Atsugi; Tadao Nakamura, Aikawa, all of Japan

[73] Assignee: Unisia Jecs Corporation, Atsugi, Japan

[21] Appl. No.: 08/797,660

[22] Filed: Jan. 31, 1997

[30] Foreign Application Priority Data

Feb. 2, 1996 [JP] Japan ..... 8-017258
Feb. 2, 1996 [JP] Japan ..... 8-017259

[51] Int. Cl.[7] ..... F04C 2/22

[52] U.S. Cl. ..... 418/8; 418/61.2

[58] Field of Search ..... 418/8, 61.2

[56] References Cited

U.S. PATENT DOCUMENTS

| | | | |
|---|---|---|---|
| 3,108,578 | 10/1963 | Scherenberg | 418/61.2 |
| 3,260,247 | 7/1966 | Gassmann et al. | 418/61.2 |
| 3,359,954 | 12/1967 | Eiermann et al. | 418/61.2 |
| 3,688,749 | 9/1972 | Wankel | 418/61.2 |
| 4,233,003 | 11/1980 | Jeng | 418/8 |
| 5,251,596 | 10/1993 | Westland | 418/61.2 |
| 5,391,067 | 2/1995 | Saunders | 418/61.2 |
| 5,410,998 | 5/1995 | Paul et al. | 418/61.2 |

FOREIGN PATENT DOCUMENTS

| | | |
|---|---|---|
| 1547670 | 10/1967 | France . |
| 64-15726 | 1/1989 | Japan . |
| 8-42462 | 2/1996 | Japan . |
| WO 94/17284 | 8/1994 | WIPO . |

*Primary Examiner*—John J. Vrablik
*Attorney, Agent, or Firm*—Foley & Lardner

[57] ABSTRACT

A lobed rotor-type pump has a drive shaft, a pump housing, an eccentric rotor journal, a rotor, three working-fluid chambers, intake and discharge ports, and a communication passage. The pump housing has a circumferentially-extending peri-trochoidal curved surface in its inner periphery. The eccentric rotor journal is fixedly connected to the drive shaft. The rotor is slideably fitted to the eccentric rotor journal. The rotor has three lobes equi-distantly spaced circumferentially around its outer periphery so that the rotor rotates eccentrically while keeping the lobes in sliding contact with the peri-trochoidal curved surface. The three working-fluid chambers, which are defined between respective three lobes and the peri-trochoidal curved surface, rotate in synchronism with the rotor. The intake and discharge ports are provided in the housing to input low-pressure incompressible fluid and to output high-pressure fluid. The communication passage is formed in the housing for communicating a first working-fluid chamber, decreasing in volume during the compression stage, and a second working-fluid chamber, increasing in volume during the expansion stage, to permit flow of incompressible fluid from the first chamber to the second chamber.

9 Claims, 6 Drawing Sheets

LOBED-ROTOR-TYPE PUMP HAVING A COMMUNICATION PASSAGE BETWEEN WORKING-FLUID CHAMBERS

BACKGROUND OF THE INVENTION

1. Field of the Invention

The present invention relates to a rotor-type pump suitable for a hydraulic pump which is used to produce the oil pressure required to circulate lubricant to automobile parts such as various moving engine parts or to deliver working fluid to power steering for instance, and specifically to techniques of a rotor-type pump substantially similar to a construction of a Wankel engine employing a rotor with three lobes each of which follows a peri-trochoidal or epi-trochoidal curved surface of a rotor housing in which the rotor turns.

2. Description of the Prior Art

As is generally known, there are several general types of oil pumps used in pressure-feed systems, for lubrication of an internal combustion engine or for delivery of working fluid to a power steering system which serves to produce a steering assistance. In one, the external gear-type pump uses a pair of meshing gears. In another, the plunger pump uses a plurality of plungers. In another, the vane pump uses a plurality of vanes radially slidably set in slots in the pump rotor. Also, the internal gear-type pump such as a trochoid pump or a gear-type oil pump with a pair of meshing gears and a crescent between the gears, is often used. To provide a higher-performance pump, it is desired to apply a basic construction of the Wankel engine (often called a four-stroke cycle rotary-combustion engine) to hydraulic pump. Hereinafter described briefly is the construction and operation of typical Wankel engines. The Wankel engine typically has a rotor housing, a pair of flat-faced side housings enclosing and sealing the rotor housing, a main shaft or a crankshaft (more accurately an eccentric shaft) with a rotor journal eccentric to the center line of the eccentric shaft (equal to the drive shaft), a substantially triangular rotor being rotatable eccentrically in the rotor housing and having three rotor lobes or apexes which are circumferentially equidistant spaced to each other on the outer periphery of the rotor and follow the epi-trochoidal curve of the inner face of the housing. An external gear (stationary gear) member is mounted in one (usually a rear side housing) of the side housings and has the bearing that supports one end of the eccentric shaft, while an internal gear is installed in the rotor. The rotor fits on the eccentric rotor journal, and the internal gear (the rotor gear) meshes with the stationary gear of the side housing and is guided by the stationary gear and revolves around the latter. The apex seals on the three lobes are in contact with and tightly fit against the inner face of the rotor housing to provide a tight seal, and thus provide three separate chambers between the respective two adjacent rotor lobes. With the internal gear (the rotor) revolving around the stationary gear of the side housing, these chambers increase and decrease in volume. This action is similar to the decrease and increase in volume in the cylinder of a reciprocating engine, as the piston moves up and down. Ordinarily, an exhaust port is formed in the rotor housing, whereas an intake port is formed in the rotor housing or in the side housing, so that the two ports are arranged parallel to each other in one curved side wall of the rotor housing. Also provided in the rotor housing is at least one spark plug (usually a pair of spark plugs are provided such that the plugs face the two ports). In case of a well-known one-rotor Wankel engine, the gear ratio between the rotor gear and the stationary gear is set at 1:3 so that the output shaft (i.e., the eccentric shaft) rotates three times every revolution of the rotor, and so that there are four stages (namely an intake stroke, a compression stroke, a power stroke and an exhaust stroke) with respect to each of three chambers defined between three rotor lobes, during one revolution of the rotor. In detail, the Wankel engine operates as follows. With rotation of the rotor after one of the rotor lobes has cleared the intake port, the space (the volumetric capacity of the chamber) between the one lobe (the leading lobe), the adjacent lobe (the trailing lobe) and the housing begins to increases to produce a partial vacuum and to cause the air-fuel mixture to enter. With a further rotation of the rotor, the space between the rotor and housing continues to increase. When the rotor reaches the point wherein the trailing lobe passes the intake port, the air-fuel mixture is sealed between the leading and trailing lobes, and then the mixture is compressed. When the mixture is nearing the maximum compression at the last stage of the compression (near TDC on the compression stroke), the spark plugs fire to ignite the mixture and thus the combustion takes place. At this stage, the hot burnt gases push the rotor to turn it further around. Thereafter, the hot gases continue to expand and the expand stroke continues until the leading lobe has cleared the exhaust port. The hot burnt gases begin to exhaust from the space between these adjacent lobes via the exhaust port and the exhaust stroke continues. Then the leading lobe has cleared the intake port again. In this manner, the four stages (complete series of actions) are repeatedly executed every revolution of the rotor. Such a conventional Wankel engine has been disclosed in Japanese Utility Model Provisional Publication No. 64-15726. As set forth above, in the Wankel engine, the complete series of actions take place between three pairs of rotor lobes. Three sets of actions which occur at the same time in the engine, provide a high engine performance. However, it is very difficult to apply the basic construction of the Wankel engine as previously noted to oil pumps used in pressure-feed lubricating systems of automotive engines, for the reasons set out below. In Wankel engine the fuel system mixes a fine spray of fuel (gasoline) with air to make a combustible and compressible air-fuel mixture and the compressible mixture is compressed on compression stroke and ignited and expanded on power stroke, whereas the oil pump is used to produce an increased pressure of incompressible working fluid. That is, the Wankel engine is applied to a compressible fluid (air-fuel mixture) and so designed to function as an internal combustion engine by way of compressing and expanding action of compressible air-fuel mixture (i.e., changes in volume in the combustion chamber). On the other hand, oil pumps must be applied to incompressible fluid such as lubricating oil for automotive moving or rotating parts or working fluid for a power steering device. Also, in the typical Wankel engines, one meshing pair (the stationary gear and the rotor gear) are provided to control the rotation of the rotor in such a proper manner that the rotor satisfactorily follows the epi-trochoidal curve of the inner face of the rotor housing and rotates eccentrically around the stationary gear. Generally, the stationary gear is mounted in the side housing, whereas the rotor gear is installed in the rotor, and thus such a guiding device composed of the stationary gear (external gear) and the rotor gear (internal gear) requires a high machining accuracy of the meshing pair. Also, such a conventional guiding device has a complicated structure and is generally constructed by many parts. If the conventional guiding device is applied to a rotor-type pump, the high accuracy of machining of the meshing gears and the complicated structure of the guiding device increase production costs of the rotor-type pump which utilizes a basic construction of the Wankel engine. Additionally, the stationary gear and the rotor gear meshing each other have required a comparatively great installing space in the housing, and thus there is a tendency that the entire size and weight of the rotor-type pump increase.

SUMMARY OF THE INVENTION

The present invention relates to techniques for optimally applying the basic construction of the Wankel engine to hydraulic pumps which use incompressible fluid. It is, therefore, an object of the present invention to provide a rotor-type pump which can provide a superior pumping action, permitting changes in the volumetric capacity of the working chambers between rotor lobes.

It is another object of the invention to provide a rotor-type pump with a simple rotor guiding device, as compared with a typical Wankel-engine rotor guiding device being comprised of a stationary gear mounted in the side housing and a rotor gear installed in the rotor.

In order to accomplish the aforementioned and other objects of the present invention, a rotor-type pump comprises a drive shaft, a housing defining therein an internal space and having a circumferentially-extending peri-trochoidal curved surface in an outer periphery of the housing, an eccentric rotor journal fixedly connected to the drive shaft for co-rotation, an axis of the eccentric rotor journal being eccentric to a center line of the drive shaft, a rotor slidably fitted to the eccentric rotor journal and having circumferentially equi-distant spaced plural lobes on an outer periphery of the rotor so that the rotor rotates eccentrically in the housing, keeping the plural lobes in sliding-contact with the peri-trochoidal curved surface, plural working-fluid chambers defined between respective two adjacent lobes of the plural lobes by the peri-trochoidal curved surface and the outer periphery of the rotor, the plural working-fluid chambers rotating in synchronization with rotation of the rotor, an intake port communicating the internal space of the housing, a discharge port communicating the internal space of the housing, and communication means for intercommunicating a first chamber of the plural working-fluid chambers, the first chamber decreasing in volume during compression stage, and a second chamber of the plural working-fluid chambers, the second chamber increasing in volume during expansion stage.

According to another aspect of the invention, a rotor-type pump comprises a drive shaft, a rotor housing having a recessed portion therein, the recessed portion being defined by a circumferentially-extending peri-trochoidal curved surface and a radially-extending flat-faced surface, and the peri-trochoidal curved surface being formed with two diametrically-opposing raised portions being point-symmetrical with respect to a center line of the drive shaft, a side cover hermetically covering an opening end of the rotor housing in a fluid-tight fashion, an eccentric rotor journal fixedly connected to the drive shaft for co-rotation, an axis of the eccentric rotor journal being eccentric to a center line of the drive shaft, a rotor slidably fitted to the eccentric rotor journal and having circumferentially equi-distant spaced three lobes on an outer periphery of the rotor so that the rotor rotates eccentrically in the housing, keeping the three lobes in sliding-contact with the peri-trochoidal curved surface, three working-fluid chambers defined between respective two adjacent lobes of the three lobes by the peri-trochoidal curved surface and the outer periphery of the rotor, the three working-fluid chambers rotating in synchronization with rotation of the rotor, an intake port communicating the internal space of the housing, a discharge port communicating the internal space of the housing, the intake port and the discharge port being provided parallel to each other, at both sides of a first raised portion of the two diametrically-opposing raised portions, and communication means for intercommunicating a first chamber of the three working-fluid chambers, the first chamber decreasing in volume during compression stage, and a second chamber of the three working-fluid chambers, the second chamber increasing in volume during expansion stage, wherein the communication means including a communication passage formed near a second raised portion of the two diametrically-opposing raised portions. The communication passage may comprise a substantially C-shaped fluid communication passage having two ports exposed through the peri-trochoidal curved surface to the recessed portion and respectively oppose the intake port and the discharge port, the two ports being opened and closed by the outer periphery of the rotor. More preferably, the communication passage may comprise a fluid-communication recessed hole formed in the radially-extending flat-faced surface of the recessed portion of the rotor housing, the fluid-communication recessed hole being opened and closed by a flat-faced side wall of the rotor. Alternatively, the communication passage may comprise a fluid-communication recessed hole formed in a flat-faced surface of the side cover facing the flat-faced surface of the recessed portion of the rotor housing. The rotor-type pump may further comprise a rotor guiding means including an endless guide groove formed in the side cover and contoured along the peri-trochoidal curved surface and three guide pins each tightly press-fitted into an axial bore formed in the rotor near the associated lobe and loosely fitted into the endless guide groove.

DESCRIPTION OF THE PREFERRED EMBODIMENTS First embodiment

Figure 1:
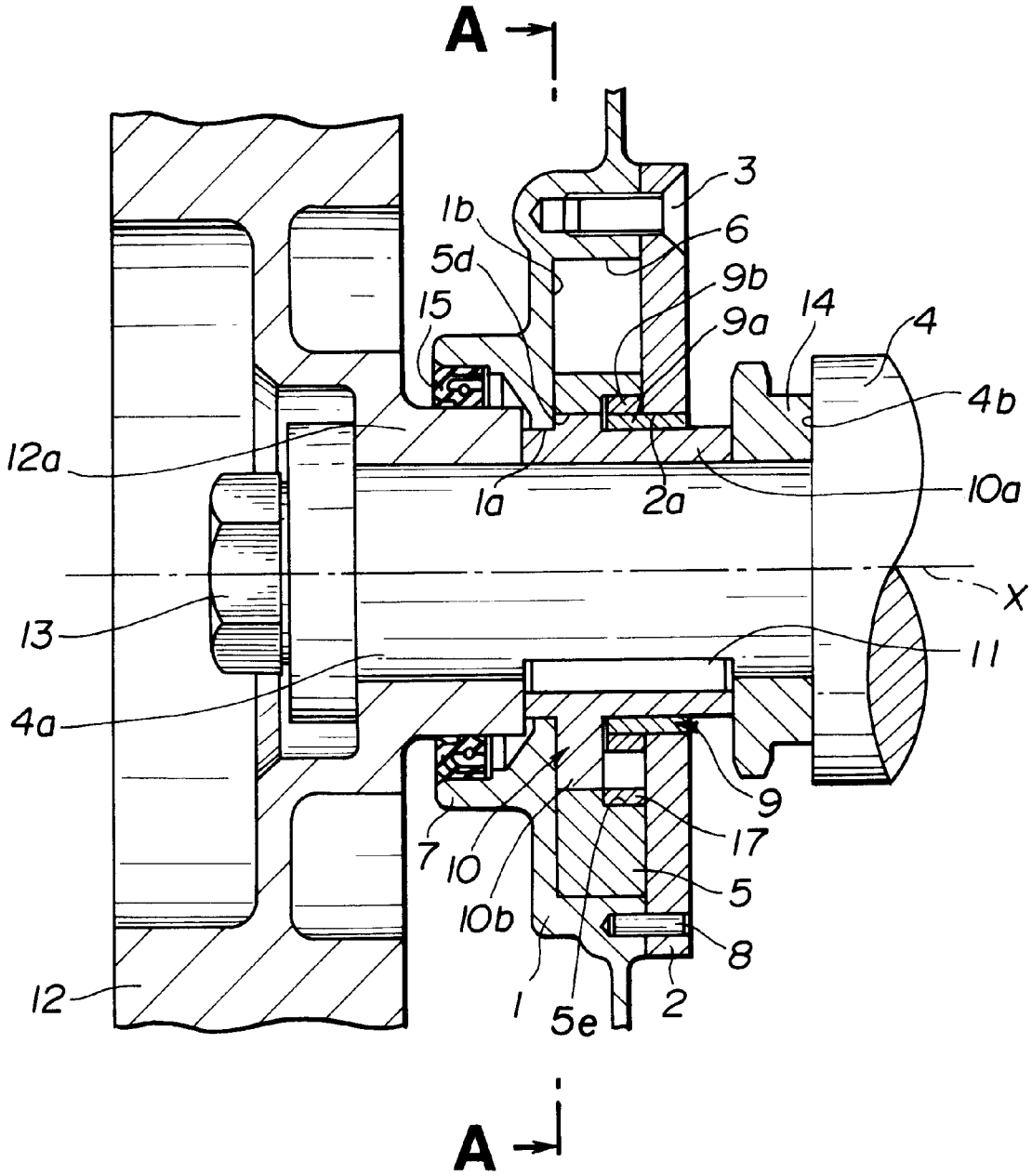
FIG. 1 is a longitudinal cross-sectional view illustrating a first embodiment of a rotor-type pump made according to the invention.
Figure 2:
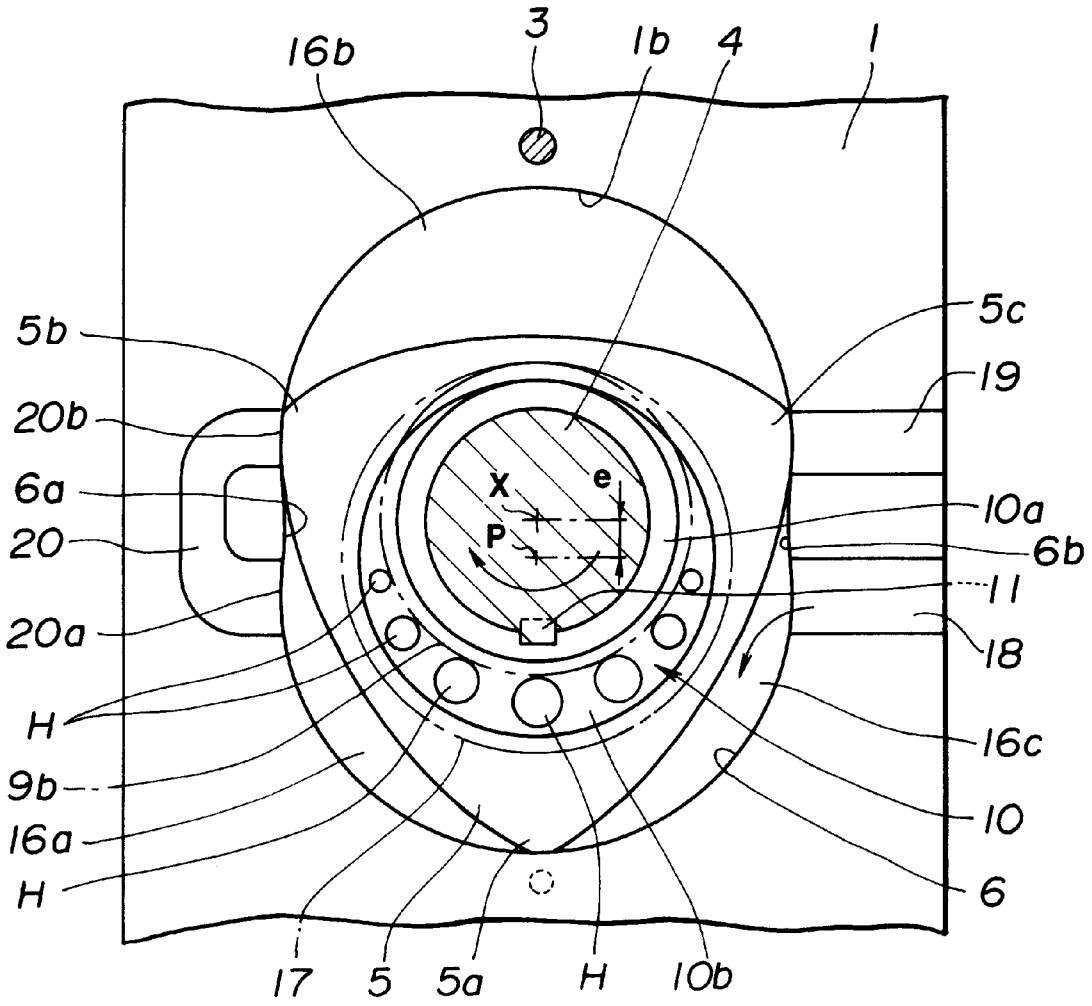
FIG. 2 is a lateral cross-sectional view taken along the line II—II of FIG. 1.

Referring now to the drawings, particularly to FIGS. 1 and 2, there is shown the front section of a pump shaft (or a drive shaft) 4 of a rotor-type pump of the first embodiment. The rotor-type pump includes a rotor housing 1 firmly secured to the stationary engine part such as a cylinder block, a side cover 2 (corresponding to a side housing) firmly secured to the rear flat-faced end of the housing in such a manner as to hermetically cover the rear opening end of the housing 1 in a fluid-tight fashion. The drive shaft 4 penetrates the circular center bore 1*a* of the housing and the circular center bore 2*a* of the cover 2. A substantially tri-angular rotor 5 is rotatably enclosed in the recessed portion 1*b* (or the internal space) of the housing 1. The rotor housing 1 and the side cover 2 constructs a pump housing assembly. The recessed portion 1*b* of the housing 1 is comprised of a circumferentially-extending endless-belt like curved surface 6 and a radially-extending flat-faced surface. The circumferentially-extending curved surface 6 of the recessed portion 1*b* of the housing is shaped as a peri-trochoidal or epi-trochoidal curved surface 6. The housing is formed integral with an essentially cylindrical oil seal housing 7 extending frontwardly from the housing side wall facing the side cover 2. The cover 2 is substantially rectangular in shape in the same manner as the contour of the rear flat-faced end of the housing 1. The cover 2 is positioned in place by means of a positioning pin 8 and firmly secured to the rear flat-faced end of the housing 1 by way of bolts such as flat-head bolts 3. Reference sign 9 denotes a stationary gear assembly composed of a cylindrical gear-mounting base 9*a* (simply a base) and an external toothed portion 9*b*. As clearly seen in FIG. 1, the base 9*a* is tightly press-fitted to the inner periphery of the center bore 2*a* of the side cover 2. The external toothed portion 9*b* is tightly press-fitted to the outer periphery of the left-hand half of the base 9*a* and thus the gear assembly 9 is stationary with respect to the side cover 2. The drive shaft 4 is directly connected to the crankshaft (not shown) of the internal combustion engine. An eccentric collar 10 is fixedly connected to the outer periphery of the drive shaft 4 by way of a key 11 tightly fitted into an elongated, axially-extending key way formed at the outer periphery of the drive shaft. A drive pulley (a timing-belt pulley) 12 is firmly secured to the relatively small-diameter front end 4*a* of the shaft 4 by means of a bolt 13. Reference sign 14 denotes a sprocket fixed onto the outer periphery of the relatively small-diameter portion of the drive shaft 4 so that the right-hand flat-faced side wall of the sprocket 14 abuts the stepped end portion (or the annular radially-extending flat face) 4*b* of the shaft 4. The pulley 12 is formed integral with an axially backwardly extending cylindrical boss-like portion 12*a* being fitted onto the outer periphery of the front end 4*a* of the drive shaft. Therefore, the rotational force or driving torque is transmitted from the pulley 12 to the drive shaft 4 through a timing belt (not shown). Also, a sealing member 15 such as an oil seal is provided in an essentially cylindrical seal mounting bore of the seal housing 7 to provide a tight seal between the outer periphery of the boss-like portion 12*a* and the inner periphery of the seal mounting bore of the seal housing 7. The previously-noted eccentric collar 10 consists of a cylindrical portion 10*a* which is fitted to the outer periphery of the drive shaft 4 and fixedly connected to the shaft 4 by way of the key and key way, and an eccentric rotor journal portion 10*b* which is formed integral with the cylindrical portion 10*a*. As best in FIG. 2, the central axis P of the eccentric rotor journal portion 10*b* is radially eccentric to the central axis X of the drive shaft 4 by a predetermined distance e. The left-hand end of the cylindrical portion 10*a* is fitted into the center bore 1*a* of the housing 1 whereas its right-hand end penetrates the center bore 2*a* of the cover 2. For the purpose of axial positioning of the eccentric rotor journal 10*b*, the left-hand flat-faced end of the cylindrical portion 10*a* abuts the right-hand flat-faced annular end of the boss-like portion 12*a* and additionally the right-hand flat-faced end of the cylindrical portion 10*a* abuts the left-hand annular flat face 4*b* of the shaft 4. Referring to FIG. 2, the eccentric rotor journal 10*b* is formed with a plurality of lightening holes H for the purpose of weight balance as well as lightening. To permit the rotational motion of the rotor 5, the axial length (or the thickness) of the rotor is designed to be slightly smaller than the axial length of the recessed portion 1*b* of the housing 1. As clearly seen in FIG. 2, the rotor has three lobes 5*a*, 5*b* and 5*c*. Defined is the working-fluid chamber between the outer peripheral curved surface over the two adjacent lobes and the peri-trochoidal curved surface 6 of the recessed portion 1*b*. Thus, three working-fluid chambers 16*a*, 16*b* and 16*c* are defined between the outer periphery of the rotor 5 and the inner peripheral face of the rotor housing 1. In the rotor-type pump, the three working-fluid chambers themselves rotate in synchronization with rotation of the rotor 5, as will be more fully discussed later. With the previously-noted arrangement, the rotor rotates eccentrically around the stationary gear assembly 9 and also follows a specified orbit that permanently keeps all of the three rotor lobes 5*a*, 5*b* and 5*c* in sliding-contact with the peri-trochoidal curved surface 6 of the housing 1. Returning to FIG. 1, the rotor 5 is formed with the central stepped bore composed of a comparatively small-diameter bore 5*d* and a comparatively large-diameter bore 5*e*. The inner periphery of the small-diameter bore 5*d* of the rotor is fitted to and rotatably supported on the outer periphery of the eccentric rotor journal 10*b* of the eccentric collar. The large-diameter bore 5*e* of the rotor is formed, on its inner periphery, with an internal toothed portion 17 (corresponding to a rotor gear) being partly meshable with the external toothed portion 9*b* of the stationary gear 9. The housing 1 are formed, at the right-hand side (viewing FIG. 2), with two essentially parallel ports, namely an intake port 18 (lower port) and a discharge port (upperport) 19. The respective ports 18 and 19 communicate the recessed portion 1*b* of the housing 1. Note that, in the rotor-type pump made according to the invention, a substantially C-shaped fluid communication passage 20 is formed in the left-hand side of the housing 1. As seen in FIG. 2, since the rotor 5 rotates clockwise during operation of the pump, with respect to the chamber 16*a* the lobe 5*b* corresponds to the leading lobe and the lobe 5*a* corresponds to the trailing lobe. As may be appreciated, the working fluid in the chamber 16*a* is in the compressed state. Assuming that under the condition shown in FIG. 2 the rotor has farther turned approximately 30 degrees and thus the leading rotor lobe 5*b* has advanced approximately 30 degrees, the fluid in the chamber 16*a* reaches the maximum compressed state. In the shown embodiment, the intake port 18 is formed in the housing 1 near the right-hand central raised portion 6*b* of the peri-trochoidal curved surface 6 which raised portion 6*b* is somewhat higher level than the intake port 18, whereas the exhaust port 19 is formed in the housing 1 near the right-hand raised portion 6*b* somewhat lower than the discharge port 19. The right-hand raised portion 6*b* and the left-hand raised portion 6*a* are diametrically opposed to each other and point-symmetrical with respect to the central axis X of the drive shaft 4. First and second ports 20*a* and 20*b* of the communication passage 20 horizontally expose through the peri-trochoidal curved surface 6 to one or two chambers in a manner so as to oppose the respective ports 18 and 19. Suppose the rotor has retarded 30 degrees from the position shown in FIG. 2. Under such a particular condition (30° -retarded position) wherein the leading rotor lobe 5*b* is positioned just at the left-hand central raised portion 6*a* of the peri-trochoidal curved surface 6, the first port 20*a* communicates the chamber 16*a*, whereas the second port 20*b* communicates the chamber 16*b*. Details of the position relationship among the four ports 18, 19, 20*a* and 20*b* and the rotor lobes are discussed below in detail. FIG. 2 shows a condition in which the first rotor lobe 5*a* just passes through the lowermost position of the peri-trochoidal curved surface 6. In this manner, when one (e.g., the first lobe 5*a*) of the three lobes is positioned at the lowermost position of the peri-trochidal curved surface, another rotor lobe (e.g., the second lobe 5*b*) begins to clear the second port 20*b* in a manner so as to block the fluid communication between the communication passage 20 and the working-fluid chamber (see the upper chamber of FIG. 2) between the other two lobes (e.g., the second and third lobes 5*b* and 5*c*), whereas another rotor lobe (e.g., the third lobe 5*c*) begins to clear the discharge port 19 in a manner so as to establish the fluid communication between the discharge port 19 and the chamber between the above-mentioned other two lobes (i.e., the lobes 5*b* and 5*c*). Supposing that the rotor has advanced 60 degrees from the rotational position shown in FIG. 2, one (e.g., the second lobe 5*b*) of the three lobes is positioned in the uppermost position of the peri-trochoidal curved surface 6. When one (e.g., the second lobe 5*b*) of the three lobes is positioned at the uppermost position of the peri-trochidal curved surface, another rotor lobe (e.g., the first lobe 5*a*) begins to clear the first port 20*a* in a manner so as to permit the fluid communication between the working-fluid chamber between the one lobe (e.g. the second lobe 5*b*) and the other lobe (e.g., the first lobe 5*a* corresponding to the trailing lobe if the second lobe 5*b* is the leading lobe) via the communication passage 20, whereas another rotor lobe (e.g., the third lobe 5*c*) has cleared the intake port 18 in a manner so as to block the fluid communication between the intake port 18 and the chamber between the above-mentioned other two lobes (i.e., the lobes 5*a* and 5*c*). In order to permit the decrease in the volumetric capacity of the chamber on the compression stage, the total volumetric capacity of the communication passage 20 is set at a predetermined volumetric capacity which is obtained by subtracting a predetermined volumetric capacity essentially corresponding to the minimum volumetric capacity (identical to the volumetric capacity of the lower-left working-fluid chamber when one of the three lobes reaches the lowermost position of the peri-trochoidal curved surface 6 and also another lobe begins to close the second port 20*b* of the communication passage) from the maximum volumetric capacity (identical to the volumetric capacity of the lower working-fluid chamber when one of the three lobes reaches the uppermost position of the peri-trochidal curved surface 6 or to the volumetric capacity of the upper working-fluid chamber when one of the three lobes reaches the lowermost position of the peri-trochidal curved surface 6). In consideration of slight fluctuations in the volumetric capacity of the communication passage 20 formed in the housing by machining, it is preferable that the total volumetric capacity of the communication passage 20 is set at a value slightly greater than the previously-noted predetermined volumetric capacity. As can be appreciated, the intake stage (see the chamber 16*c* of FIG. 2) of the rotor-type pump of the embodiment is similar to the intake stroke of the typical Wankel engine, and also the discharge stage (in FIG. 2 the the chamber 16*b* begins to the discharge stage) of the pump of the embodiment is similar to the exhaust stroke of the Wankel engine. Note that the compression and expansion stages of the exemplified pump are considerably different from those of the Wankel engine. In case of a typical Wankel engine which uses a compressible air-fuel mixture, three chambers between rotor lobes are separated from each other by apex seals and thus a certain chamber, in which the stroke is compression, is completely separated from another chamber, in which the stroke is expansion. On the other hand, in the rotary-type pump of the invention which uses an incompressible fluid, the chamber (e.g., the lower-left chamber 16*a*), in which the stage is compression, is communicated with the chamber (e.g., the upper-left or upper chamber 16*b*), in which the stage is expansion, via the communication passage 20 for a predetermined time duration from the time when the leading lobe has cleared the first port 20*a* to the time when the leading lobe has cleared the second port 20*b*, so as to permit changes in the volumetric capacity of the two adjacent chambers whose stages are compression and expansion strokes. With the previously-discussed arrangement of the rotor-type pump of the first embodiment operates as follows.

The eccentric collar 10 rotates together with the drive shaft 4 when the drive shaft 4 is rotated by way of the drive pulley 12, and thus the rotational force (torque) is transmitted through the outer peripheral surface of the eccentric rotor journal portion 10*b* to the rotor 5. In the first embodiment, since the meshing-gear type rotor guiding device (namely the stationary gear 9 and the rotor gear 17) is provided to properly control or guide the rotation of the rotor 5, the rotor rotates eccentrically around the stationary gear 9, following a specified orbit that permanently keeps all of the rotor lobes 5*a* through 5*c* in sliding-contact with the peritrochoidal curved surface 6 of the recessed portion 1*b* of the rotor housing. As soon as a certain trailing rotor lobe (see the lobe 5*c* of FIG. 2) closes the discharge port 19, the working fluid (or lubricating oil) is sucked into the chamber (see the chamber 16*c*) between the leading and trailing rotor lobes (see the two lobes 5*a* and 5*c* of FIG. 2). When the rotor farther turns 60 degrees from the position shown in FIG. 2, the previously-noted leading lobe approaches to the first port 20*a* but the first port is still closed, whereas the previously-noted trailing lobe has just cleared the intake port 18. As a consequence the volumetric capacity of the chamber between the leading and trailing lobes increases up to the maximum. Then the compression stage of this chamber begins. As soon as the compression stage starts, the volumetric capacity of the chamber begins to decrease and simultaneously a first chamber 16*a* (decreasing in volume) is communicated, via the communication passage 20 with the first port 20 opened, with a second chamber 16*b* (increasing in volume and lying near the leading lobe associated with the first chamber). Thus, on the compression stage, the rotor curved peripheral surface extending between the leading and trailing lobes (5*b* and 5*a*) serves as a pressure surface which thrusts out or pushes out the working fluid (or lubricating oil) from the first chamber (decreasing in volume and being subjected to the compression stroke) to the second chamber (increasing in volume and being subjected to the expansion stroke) by virtue of the communication passage 20. This permits the decrease in volume in the first working-fluid chamber. The stage of the chamber 16*a* of FIG. 2 is the middle stage of the compression operation. In the middle stage of the compression, for example the lobe 5*b* begins to close the second port 20*b*. Then, the stage shifts from the last stage of the compression to the expansion stage. Once more again, note that the chamber being subjected to the expansion stage cooperates with the chamber being subjected to the compression stage. The stage of the chamber 16*b* of FIG. 2 is the last stage of the expansion operation. Under this condition when the rotor farther rotates, the leading lobe (see the lobe 5*c*) associated with the chamber 16*b* begins to clear the discharge port 19 with the result that the chamber 16*b* is communicated with the discharge port 19 and thus working fluid or lubricating oil in the chamber 16*b* is pressurized and forced out from the chamber 16*b* into the discharge port 19 by the rotation of the rotor (particularly by the rotation of the curved rotor pressure surface extending between the leading and trailing lobes 5*c* and 5*b* associated with the chamber 16*b*). In this manner, a series of pumping action can be achieved by the provision of the communication passage 20. As comparing the rotor-type pump of the first embodiment with a prior art internal gear-type pump of the same size as the former, the total volumetric capacity of all working-fluid chambers in the rotor-type pump is greater than that of the internal gear-type pump and thus the displacement per one revolution of the rotor is relatively great. From the viewpoint of the pump efficiency, the rotor-type pump is superior to the typical-internal gear-type pump. If the same displacement is required, the rotor-type pump can be designed to be smaller than the internal gear-type pump, and thus the total weight of the pumping system can be decreased.

Second embodiment

Figure 3:
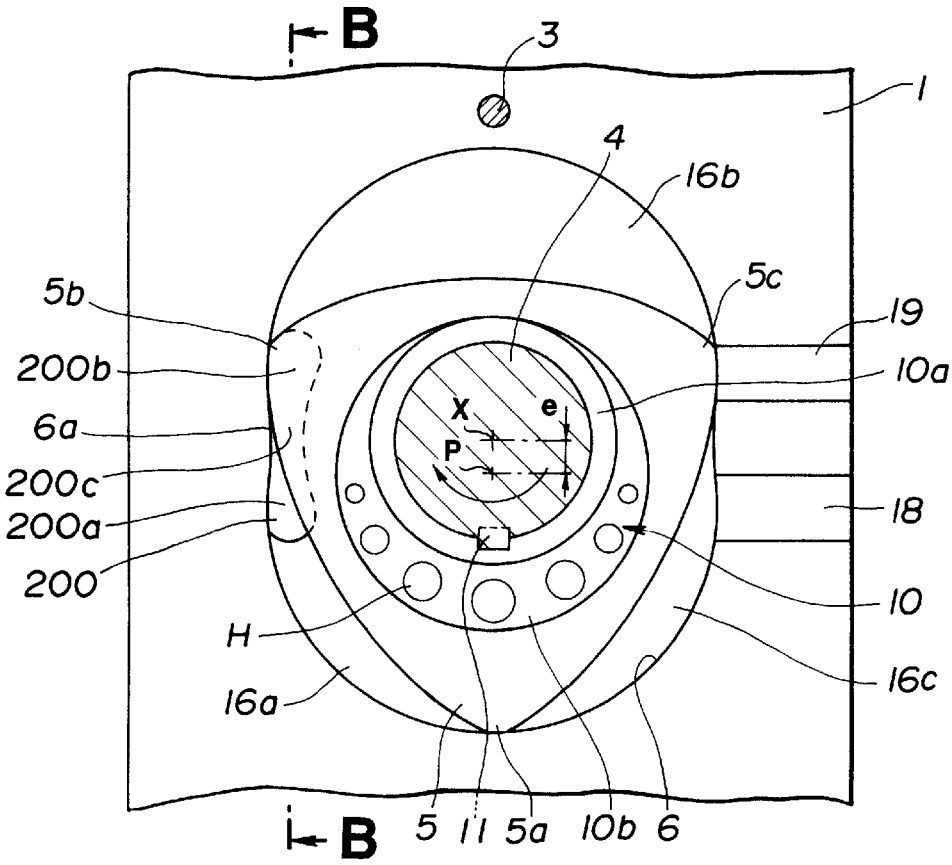
FIG. 3 is a lateral cross-sectional view illustrating a second embodiment of a rotor-type pump of the invention.
Figure 4:
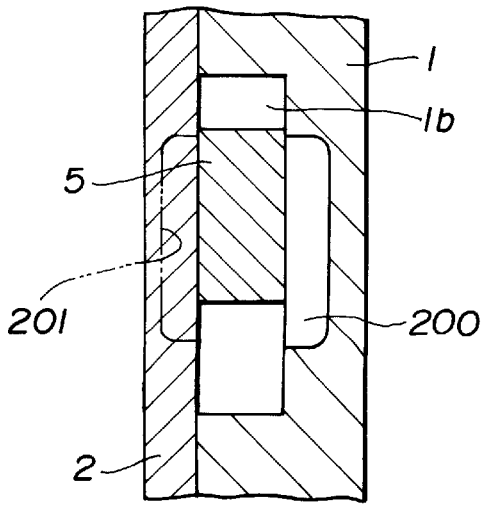
FIG. 4 is a partial cross-sectional view taken along the line IV—IV of FIG. 3.
Figure 4A:
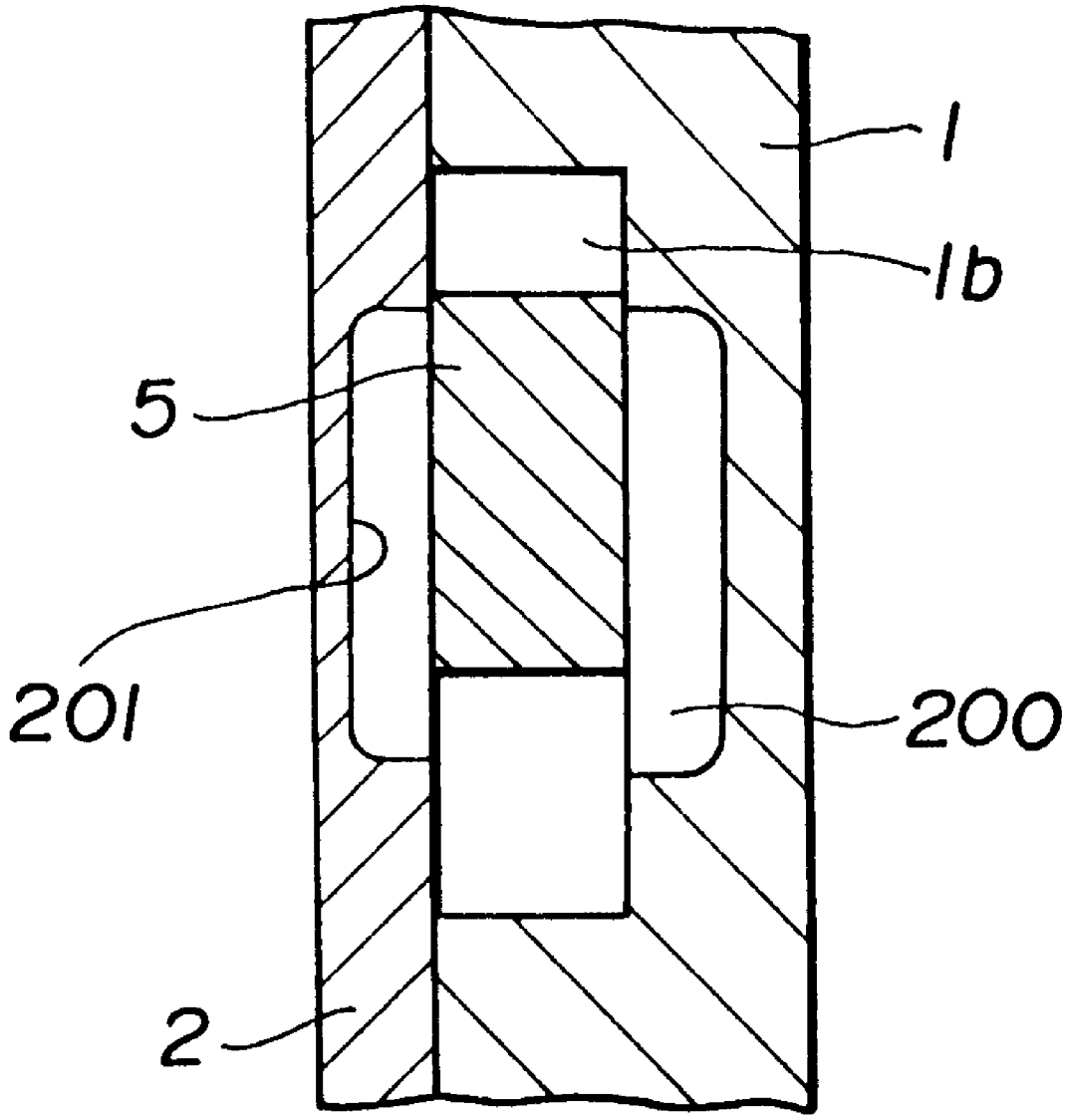
FIG. 4A is a partial cross-sectional view similar to FIG. 4, showing a modified communication passage.

Referring now to FIGS. 3 and 4, there is shown the rotor-type pump of the second embodiment. The construction of the rotor-type pump of the second embodiment is similar to that of the first embodiment, and thus the same reference signs used to designate elements in the rotor-type pump of the first embodiment as shown in FIGS. 1 and 2 will be applied to the corresponding elements used in the second embodiment, for the purpose of comparison of the first and second embodiments. The second embodiment is slightly different from the first embodiment in that in case of the first embodiment the communication passage 20 required for the compression and expansion operations is formed in the left-hand side of the rotor housing 1 such that its two ports 20*a* and 20*b* respectively oppose the intake and discharge ports 18 and 19 and formed in the peri-trochoidal curved surface 6 of a comparatively narrow axial length, whereas in case of the second embodiment a communication passage 200 required for the compression and expansion operations is formed in a comparatively wide radially-extending flat-faced portion of the recessed portion 1*b* of the rotor housing 1 as a fluid-communication recessed hole (200*a*, 200*b*, 200*c*) so that the recessed hole faces the flat-faced side wall of the rotor 5. In case of the first embodiment, the ports 20*a* and 20*b* are opened and closed by way of the lobes (5*a*, 5*b*, 5*c*) on the rotor curved peripheral surface. In contrast, in case of the second embodiment, the upper rounded portion 200*b* of the vertically-extending elongated I-shaped communication passage 200 and the lower rounded portion 200*a* of the communication passage 200 are opened and closed by way of one flat-faced side wall of the rotor 5. That is, the lower and upper rounded portions 200*a* and 200*b* of the communication passage 200 correspond to the respective ports 20*a* and 20*b*, and the relatively narrow medium portion 200*c* serves to intercommunicate the upper and lower rounded portions 200*a* and 200*b*. To provide a proper pumping action by cooperation between the chamber subjected to the compression state and the chamber subjected to the expansion stage, the I-shaped, recessed communication passage 200 of the second embodiment is so designed to be symmetrical with respect to the horizontal line passing through the two points, namely the central axis of the drive shaft 4 and the left-hand raised portion 6*a* of he peri-trochoidal curved surface. As may be appreciated, the machining of the I-shaped, recessed communication passage 200 is easier than that of the C-shaped communication passage 20. According to the second embodiment, the manufacturing efficiency can be further enhanced, thus reducing production costs. Referring to FIG. 4A, the modification of the I-shaped, recessed communication passage is indicated by 201. In consideration of reduction in the production costs, the modified communication passage 201 is formed in the side cover 2 but not in the rotor housing 1.

Third Embodiment

Figure 5:
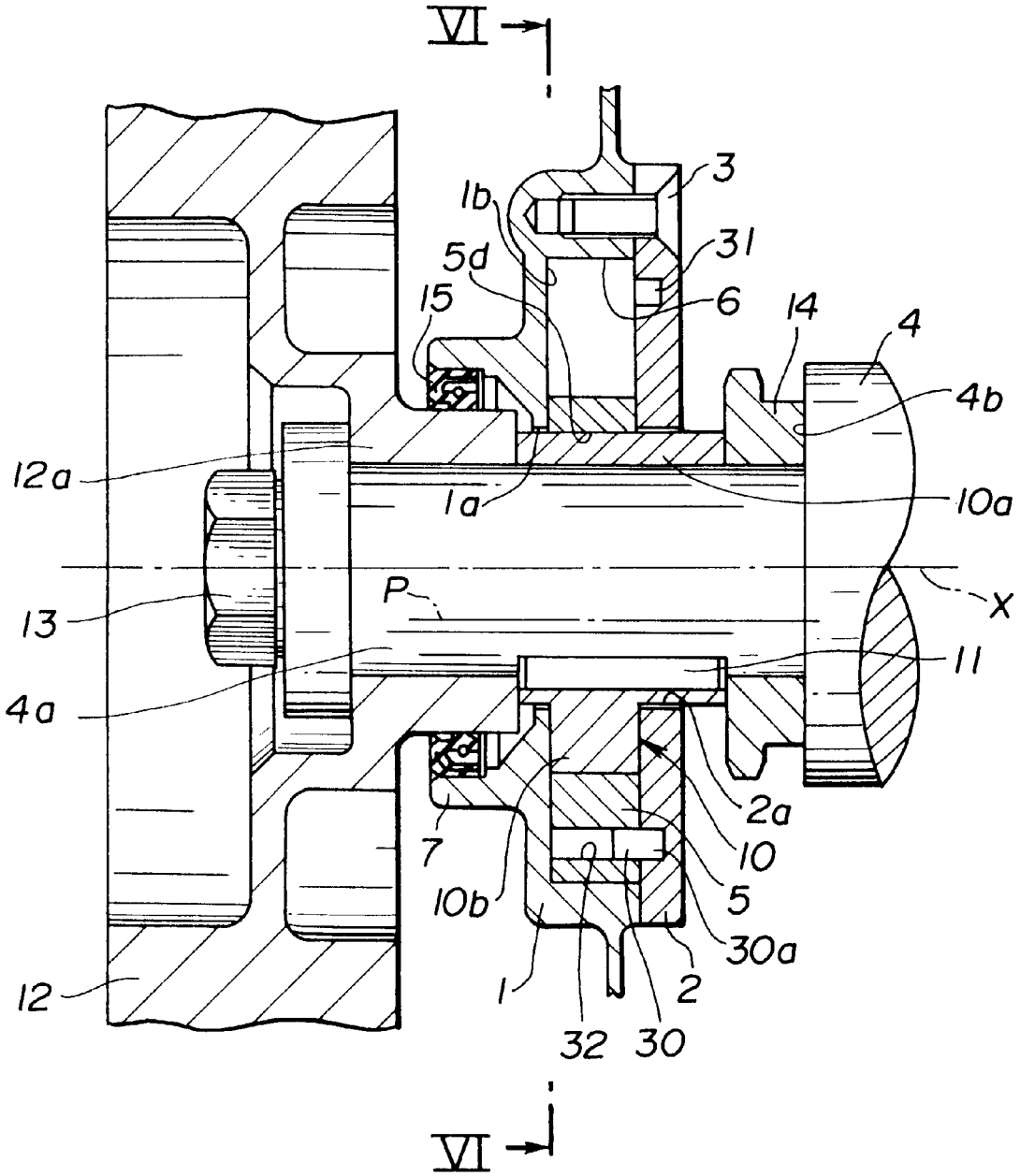
FIG. 5 is a longitudinal cross-sectional view illustrating a rotor-type pump of a third embodiment with an improved rotor guiding device.
Figure 6:
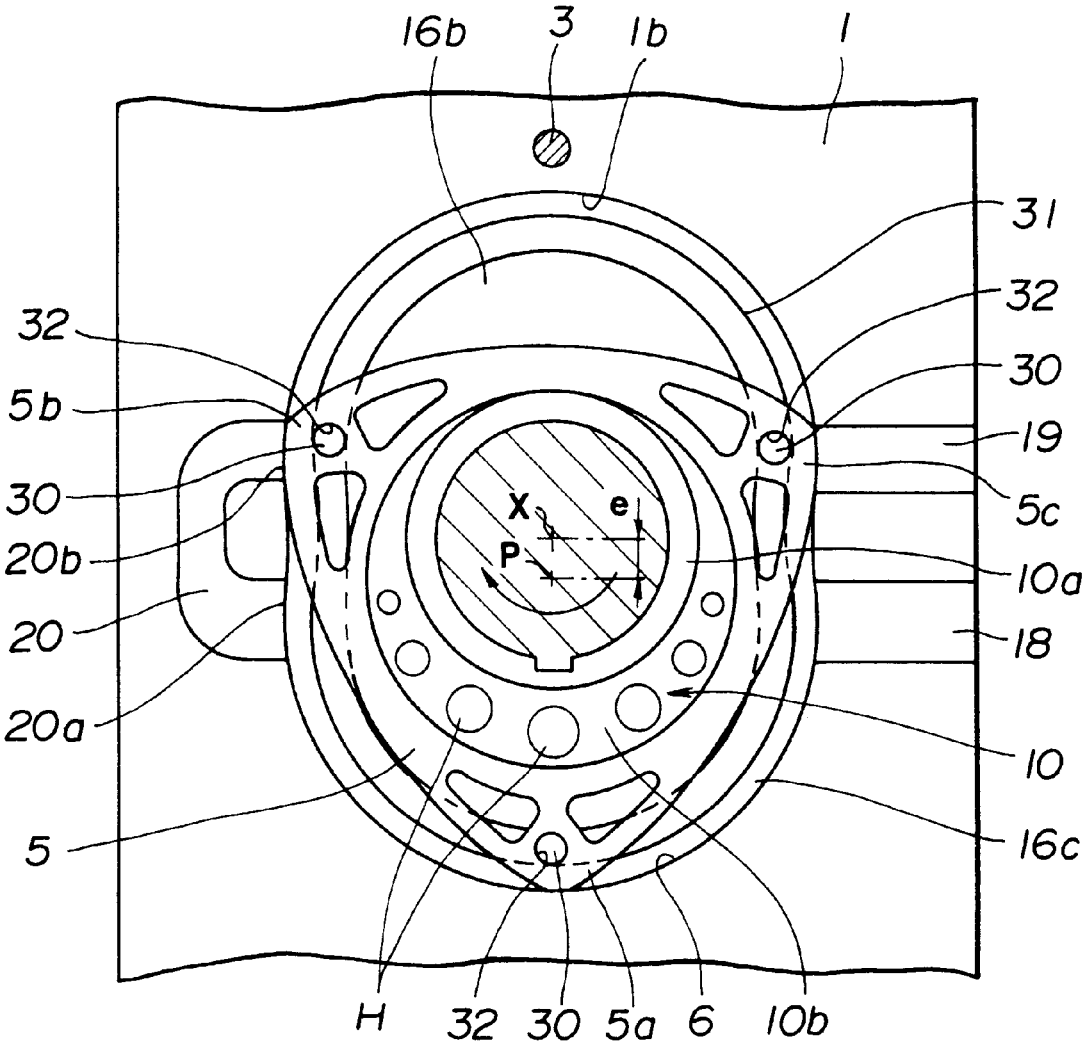
FIG. 6 is a lateral cross-sectional view taken along the line VI—VI of FIG. 5.
Figure 1:
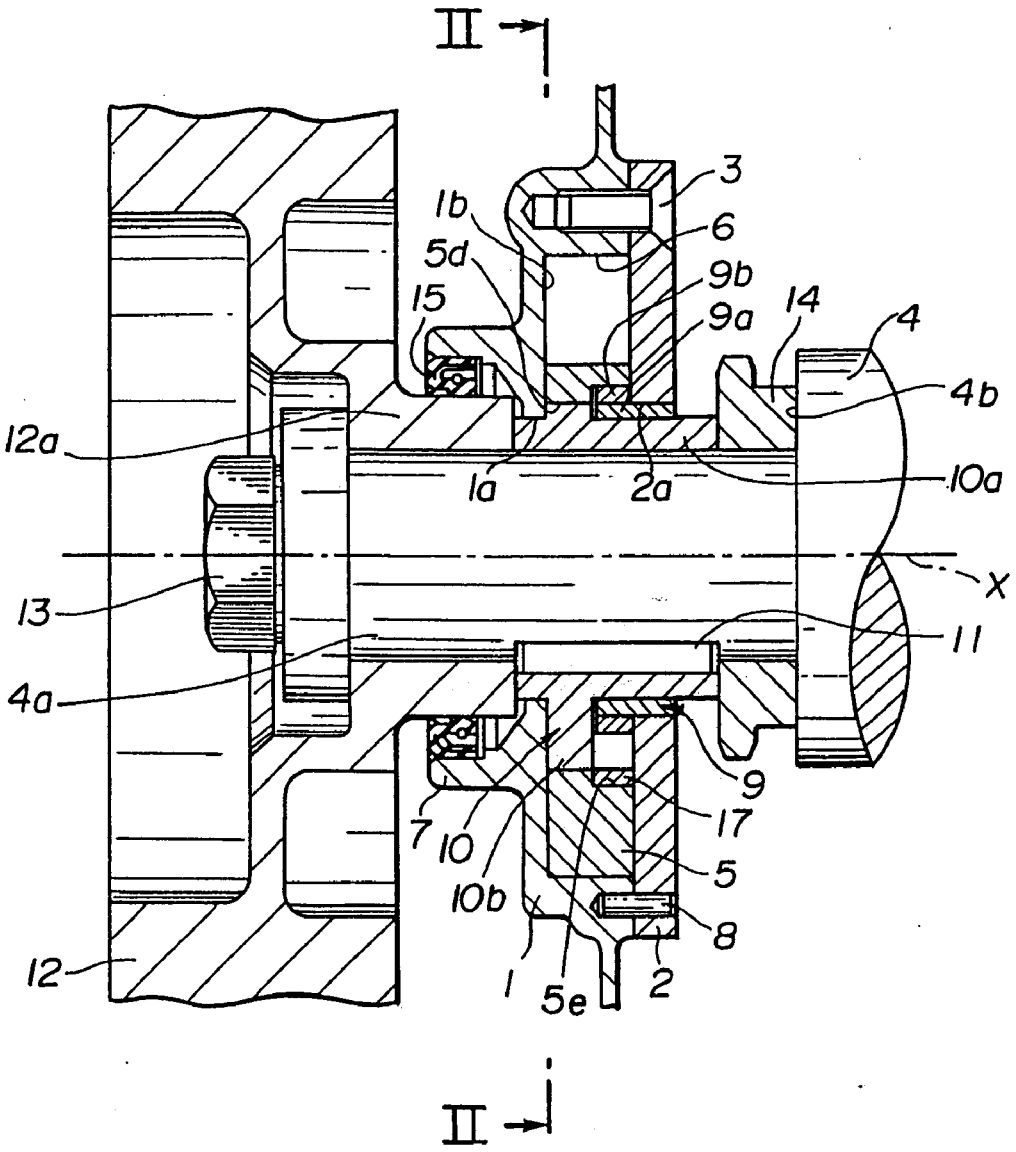
Figure 2:
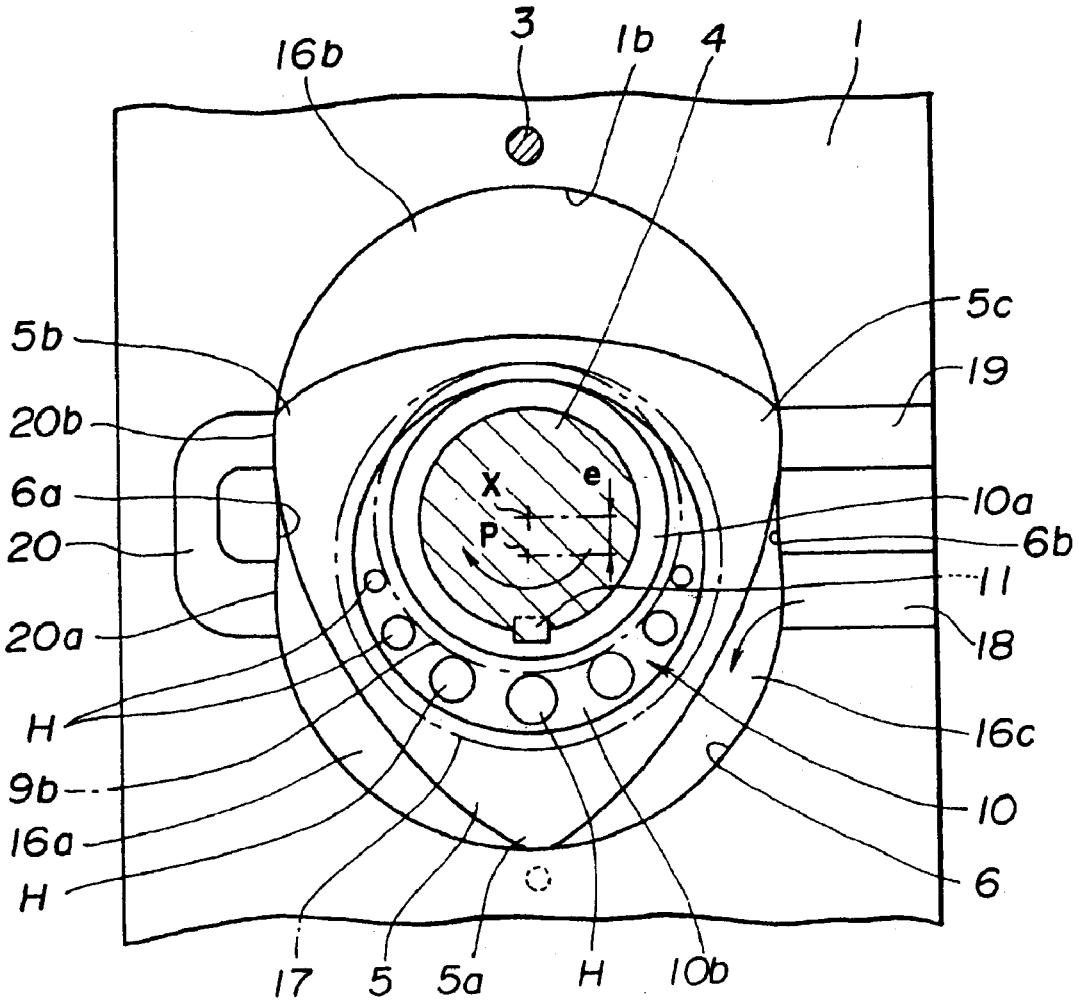
Figure 3:
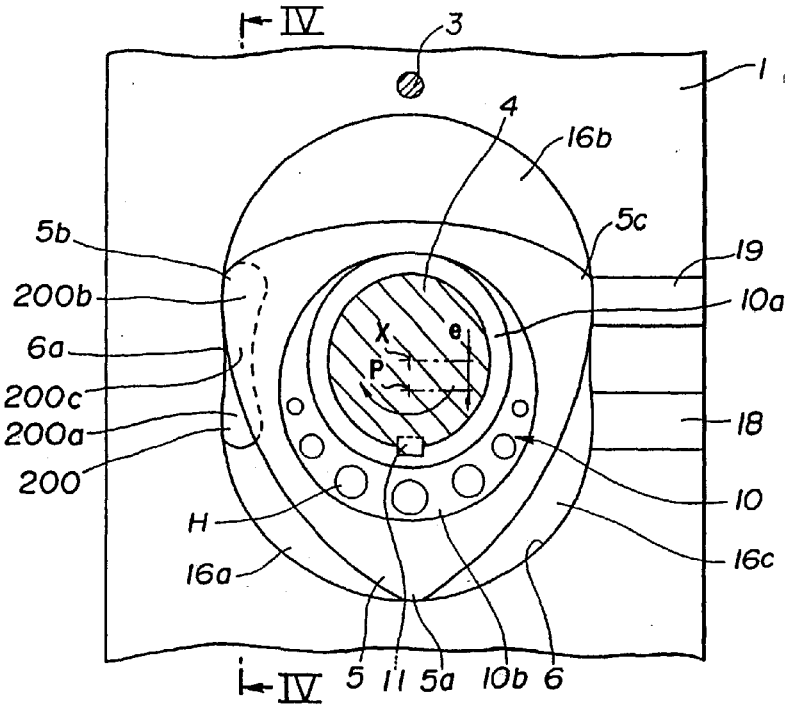
Figure 4:
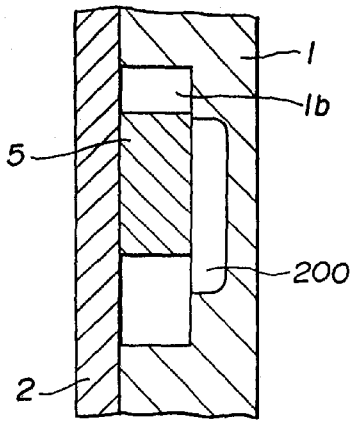
Figure 4A:
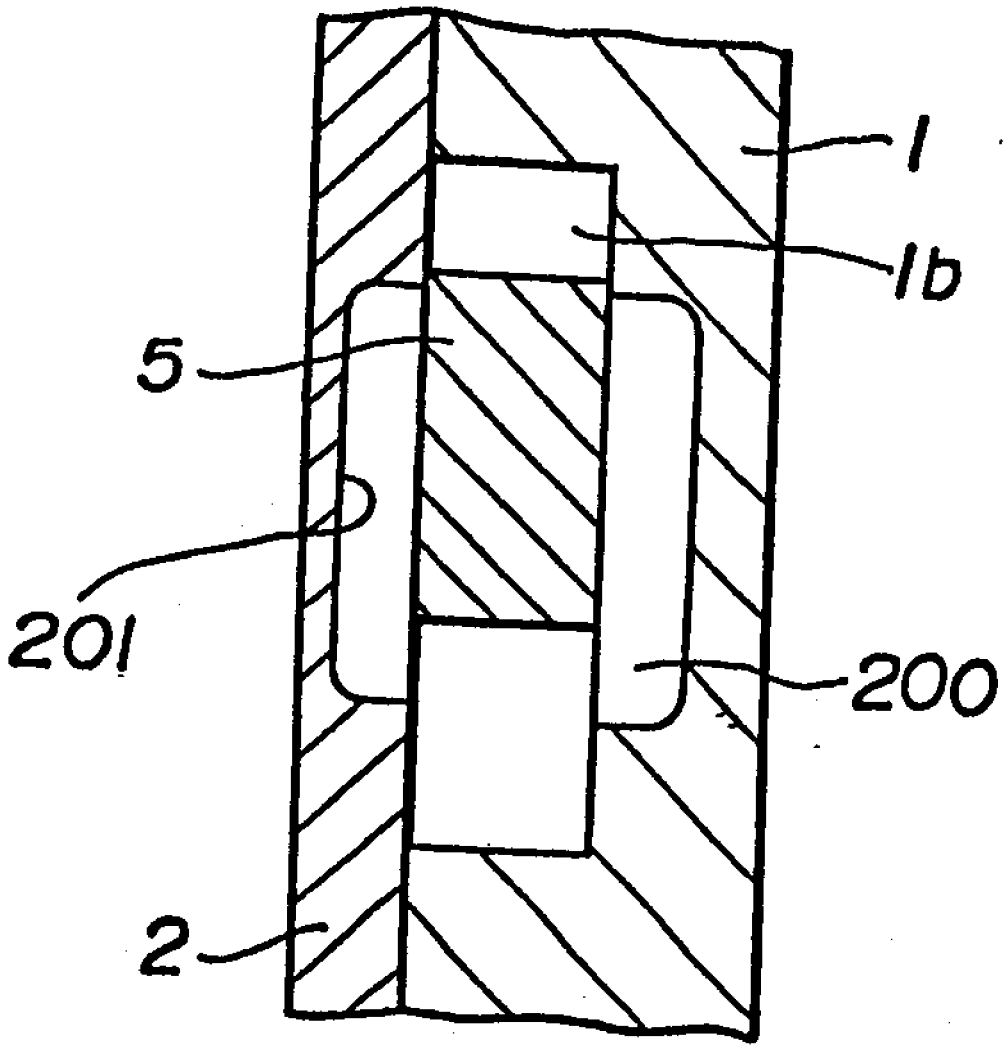
Figure 5:
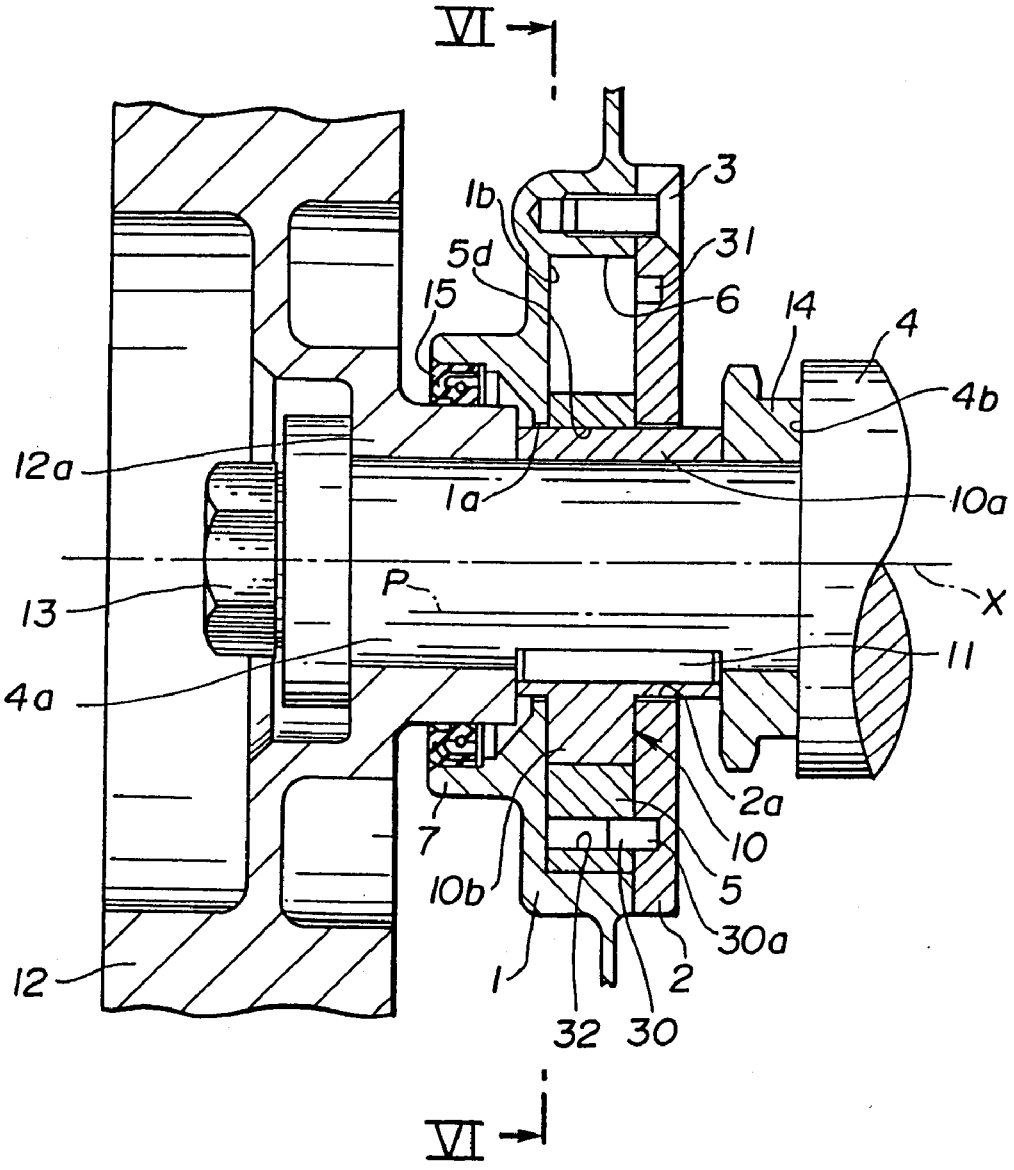
Figure 6:
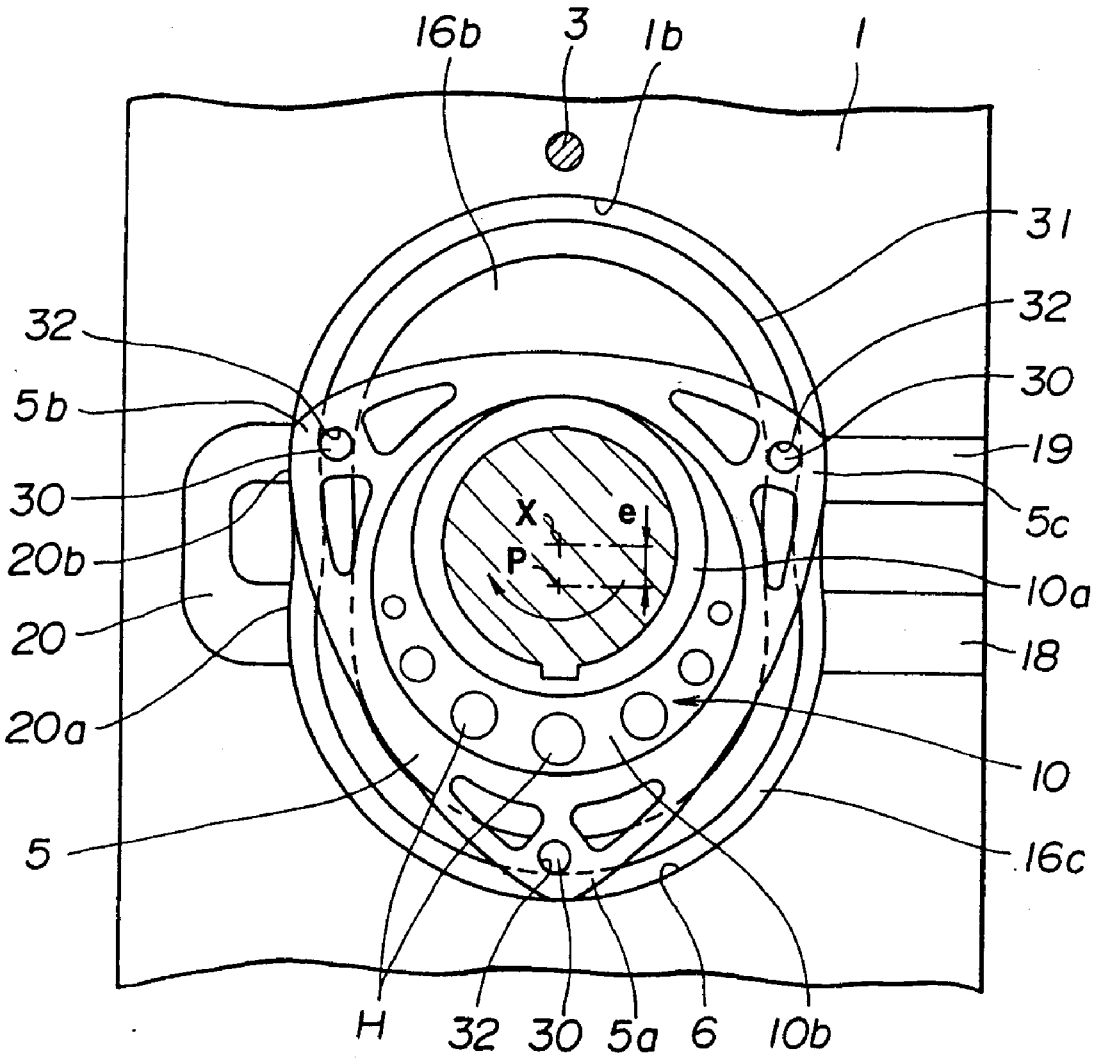

As appreciated from FIGS. 5 and 6, the construction of the rotor-type pump of the third embodiment is almost similar to that of the first embodiment and thus the same reference signs used to designate elements in the first embodiment will be applied to the corresponding elements used in the third embodiment, for the purpose of comparison of the first and third embodiments. In case of the first embodiment, the rotor guiding device composed of the stationary gear assembly 9 tightly fitted to the rear side cover 2 and the rotor gear 17 installed on the inner periphery of the rotor 5 controls the rotation of the rotor by way of partial meshed-engagement between the stationary gear and the rotor gear. Briefly speaking, the improved rotor guiding device of the third embodiment utilizes the cam connection between an endless guide groove 31 which is formed in the side cover 2 in such a manner as to be precisely contoured along the peri-trochoid curve of the curved surface 6 and three guide pins 30 which are fitted to the rotor 5 near the three lobes 5*a* through 5*c*. As seen in FIG. 5, the peri-trochoidal curved guide groove 31 is formed into a rectangular shape in cross-section by a bottom surface and two opposing side walls and defined in the inside wall of the side cover 2. Each of the three guide pins 30 is a parallel pin with two flat ends. These guide pins 30 are tightly press-fitted to the respective guide-pin holes (or cylindrical axial bores) 32 formed in the rotor near the three lobes 5*a*, 5*b* and 5*c*. The guide-pin end 30*a* (corresponding to a portion of the guide pin 30 projected from the flat-faced surface of the rotor 5) is loosely fitted into the guide groove 31 to permit a smooth eccentric rotation of the rotor. Although it is not clearly shown in FIG. 5, there is a slight clearance between the tip of the guide-pin end 30*a* and the guide-groove bottom surface facing the flat end of the pin 30, and the outside diameter of the pin 30 is slightly smaller than the distance between the two opposing side walls of the guide groove 31 to insure a loose fit between the guide pins 30 and the guide groove 31. In the third embodiment, the three guide-pin holes 32 are axially bored in the rotor near the three rotor lobes so that the center axis of each guide-pin hole 32 is located on the line segment between the associated apex of the rotor and the central axis P of the eccentric rotor journal 10*b* and the three guide-pin holes 32 match the peri-trochoidal curved guide groove. With the arrangement of the improved simple rotor guiding device, when the drive shaft 4 is driven by the drive pulley 12, the three guide pins 30 smoothly slide along the peri-trochoidal curved guide groove 31, and whereby he rotor 5 can smoothly and eccentrically rotate, following an orbit that keeps all of the three lobes 5*a*, 5*b* and 5*c* in sliding-contact with the peri-trochoidal curved surface 6. The rotor-type pump of the third embodiment uses a simplified rotor guiding device comprising a peri-trohoidal curved guide groove 31 and three guide pins 30 in cam-connection with the guide groove 31, instead of a conventional complicated rotor guiding device comprising a stationary gear attached to a rotor side cover (or a rotor side housing) and an internal rotor gear in meshed-engagement with the stationary gear. This reduces the number of parts of the rotor-type pump, thereby enhancing the manufacturing efficiency and decreasing the total production costs of the pump. The installation space for the simplified rotor guiding device (having the guide pins 30 and the guide groove 3) is smaller than the prior art rotor guiding device (having the stationary gear and the rotor gear), and thus the rotor-type pump can be small-sized. In the third embodiment the guide groove 31 is formed in the side cover 2. Alternatively, the guide groove may be formed in the radially-extending flat-faced portion of the rotor housing and the three guide pins may be projected frontwardly for loose fit between the guide pins and the guide groove. Also, it will be appreciated that the rotor-type pump of the invention may be applied to all kinds of incompressible fluid as well as hydraulic oil.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A lobed-rotor-type pump for pumping an incompressible fluid, having a communication passage between working-fluid chambers, said lobed-rotor-type pump comprising:

a drive shaft;

a housing defining therein an internal space and having a circumferentially-extending peri-trochoidal curved surface in an inner periphery of said housing;

an eccentric rotor journal fixedly connected to said drive shaft for co-rotation, an axis of said eccentric rotor journal being eccentric to a center line of said drive shaft;

a rotor slidably fitted to said eccentric rotor journal and having a plurality of circumferentially equi-distant spaced lobes on an outer periphery of said rotor so that said rotor rotates eccentrically in said housing, keeping said lobes in sliding-contact with said peri-trochoidal curved surface;

plurality of working-fluid chambers defined between respective two adjacent lobes by said peri-trochoidal curved surface and the outer periphery of said rotor, said working-fluid chambers rotating in synchronism with said rotor;

an intake port communicating the internal space of said housing;

a discharge port communicating the internal space of said housing; and a communication passage for intercommunicating a first chamber of said working-fluid chambers, said first chamber decreasing in volume during compression state, and a second chamber of said working-fluid chambers, said second chamber increasing in volume during expansion stage, wherein a total volumetric capacity of said communication passage is set at a value equal to or greater than a predetermined volumetric capacity, which is obtained by subtracting a minimum volumetric capacity of said first chamber from a maximum volumetric capacity of said first chamber to permit decrease in the volumetric capacity of said first chamber during the compression stage.

2. A lobed-rotor-type pump for pumping an incompressible fluid, having a communication passage between working-fluid chambers, said lobed-rotor-type pump comprising:

a drive shaft;

a rotor housing having a recessed portion therein, said recessed portion being defined by a circumferentially-extending peri-trochoidal curved surface and a radially-extending flat-faced surface, and said peri-trochoidal curved surface being formed with two diametrically-opposing raised portions that are point-symmetrical with respect to a center line of said drive shaft;

a side cover hermetically covering an opening end of said rotor housing in a fluid-tight fashion;

an eccentric rotor journal fixedly connected to said drive shaft for co-rotation, an axis of said eccentric rotor journal being eccentric to the center line of said drive shaft;

a rotor slidably fitted to said eccentric rotor journal and having circumferentially equi-distant spaced three lobes on an outer periphery of said rotor so that said rotor rotates eccentrically in said rotor housing, keeping said three lobes in sliding-contact with said peri-trochoidal curved surface;

three working-fluid chambers defined between said three lobes by said peri-trochoidal curved surface and the outer periphery of said rotor, said three working-fluid chambers rotating in synchronization with rotation of said rotor;

an intake port communicating with a third chamber of said three-working-fluid chambers;

a discharge port communicating with a second chamber of said three working-fluid chambers;

said intake port and said discharge port being provided parallel to each other, at both sides of a first raised portion of said two diametrically-opposing raised portions; and a communication passage for intercommunicating a first chamber of said three working-fluid chambers, said first chamber decreasing in volume during compression stage, and said second chamber increasing in volume during expansion stage, wherein said communication passage is formed near a second raised portion of said two diametrically-opposing raised portions, and wherein a total volumetric capacity of said communication passage is set at a value equal to or greater than a predetermined volumetric capacity, which is obtained by subtracting a minimum volumetric capacity of said first chamber from a maximum volumetric capacity of said first chamber to permit decrease in the volumetric capacity of said first chamber during the compression stage.

3. A lobed-rotor-type pump as claimed in claim 2, wherein said communication passage comprises a substantially C-shaped fluid communication passage having two ports exposed through said peri-trochoidal curved surface to said recessed portion and respectively oppose said intake port and said discharge port, said two ports being opened and closed by the outer periphery of said rotor.

4. A lobed-rotor-type pump as claimed in claim 2, wherein said communication passage comprises a fluid-communication recessed hole formed in said radially-extending flat-faced surface of said recessed portion of said rotor housing, said fluid-communication recessed hole being opened and closed by a flat-faced side wall of said rotor.

5. A lobed-rotor-type pump as claimed in claim 2, wherein said communication passage comprises a fluid-communication recessed hole formed in a flat-faced surface of said side cover facing said flat-faced surface of said recessed portion of said rotor housing.

6. A lobed-rotor-type pump as claimed in claim 1, further comprising a rotor guiding means including an endless guide groove formed in said housing and contoured along said peri-trochoidal curved surface and a plurality of guide pins each fixedly connected to the associated lobe of said rotor, and projecting from a flat-faced surface of said rotor, said guide pins being loosely fitted into said endless guide groove, and wherein a predetermined clearance is formed between a tip end of each of said guide pins and a bottom surface of said endless guide groove, and an outside diameter of each of said guide pins is smaller than a distance between two opposing side walls of said endless guide groove to insure a loose fit between said guide pins and said endless guide groove.

7. A lobed-rotor-type pump as claimed in claim 1, further comprising a side cover and a rotor guiding means including an endless guide groove formed in said side cover, hermetically covering an opening end of said housing in a fluid-tight fashion and contoured along said peri-trochoidal curved surface and three guide pins each tightly press-fitted into an axial bore formed in said rotor near the associated lobe and loosely fitted into said endless guide groove, and wherein a predetermined clearance is formed between a tip end of each of said guide pins and a bottom surface of said endless guide groove, and an outside diameter of each of said guide pins is smaller than a distance between two opposing side walls of said endless guide groove to insure a loose fit between said guide pins and said endless guide groove.

8. A lobed-rotor-type pump as claimed in claim 2, further comprising a rotor guiding means including an endless guide groove formed in said housing and contoured along said peri-trochoidal curved surface and a plurality of guide pins each fixedly connected to the associated lobe of said rotor and projected from a flat-faced surface of said rotor, said guide pins being loosely fitted into said endless guide groove and wherein a predetermined clearance is formed between a tip end of each of said guide pins and a bottom surface of said endless guide groove, and an outside diameter of each of said guide pins is smaller than a distance between two opposing side walls of said endless guide groove to insure a loose fit between said guide pins and said endless guide groove.

9. A lobed-rotor-type pump as claimed in claim 2, further comprising a rotor guiding means including an endless guide groove formed in said side cover and contoured along said peri-trochoidal curved surface and three guide pins each tightly press-fitted into an axial bore formed in said rotor near the associated lobe and loosely fitted into said endless guide groove, and wherein a predetermined clearance is formed between a tip end of each of said guide pins and a bottom surface of said endless guide groove, and an outside diameter of each of said guide pins is smaller than a distance between two opposing side walls of said endless guide grooves to insure a loose fit between said guide pins and said endless guide groove.

* * * * *

UNITED STATES PATENT AND TRADEMARK OFFICE

CERTIFICATE OF CORRECTION

PATENT NO. : 6,106,250
DATED : August 22, 2000
INVENTOR(S) : Shoji Morita et al.

It is certified that error appears in the above-identified patent and that said Letters Patent is hereby corrected as shown below:

Drawings,
Please publish the 6 Drawing Sheets, Figures 1-6 attached.

Signed and Sealed this

Twenty-fourth Day of December, 2002

JAMES E. ROGAN
*Director of the United States Patent and Trademark Office*